United States Patent [19]

Andersson et al.

[11] Patent Number: 4,989,736

[45] Date of Patent: Feb. 5, 1991

[54] PACKING CONTAINER AND BLANK FOR USE IN THE MANUFACTURE THEREOF

[75] Inventors: Thorbjörn Andersson, Södra Sandby; Niklas Rydh, Malmö, both of Sweden

[73] Assignee: AB Profor, Lund, Sweden

[21] Appl. No.: 398,477

[22] Filed: Aug. 25, 1989

[30] Foreign Application Priority Data

Aug. 30, 1988 [SE] Sweden ..... 8803023

[51] Int. Cl.[5] ..... B65D 5/74

[52] U.S. Cl. ..... 206/631.3; 229/123.1

[58] Field of Search ..... 206/631, 631.1, 631.2, 206/631.3, 632, 484, 484.2; 229/123.1, 125.42

[56] References Cited

U.S. PATENT DOCUMENTS

| | | | |
|---|---|---|---|
| 3,256,981 | 6/1966 | Kurtz | 206/632 |
| 3,655,503 | 4/1972 | Stanley et al. | 206/632 |
| 4,521,467 | 6/1985 | Berger | 206/632 |
| 4,705,174 | 11/1987 | Goglio | 206/632 |
| 4,712,727 | 12/1987 | Wyberg | 206/631.3 |
| 4,744,467 | 5/1988 | Jonsson et al. | 206/631.3 |
| 4,875,587 | 10/1989 | Lulhan et al. | 206/484 |

FOREIGN PATENT DOCUMENTS 1120503 7/1968 United Kingdom ..... 206/631.3

*Primary Examiner*—Gary E. Elkins

*Attorney, Agent, or Firm*—Burns, Doane, Swecker & Mathis

[57] ABSTRACT

Packing containers and packing container blanks of the type used for the packaging of, e.g., milk and juice, often are of the so-called gable-top type, in which the top closure also serves as an opening arrangment with a pouring spout which can be folded outwardly. The parts of the packing container or the blank forming the pouring spout may be partially coated with a seal-preventing substance to make it possible for the pouring spout to be detached and opened outwardly in spite of the heat-sealing of the top. The seal-preventing coating in accordance with the invention is covered by a film which extends along the upper edge region of the packing container to provide a better defined sealing strength, a tighter top seal, and protection to the coating both before and after the conversion of the packing container blank to packing containers.

11 Claims, 2 Drawing Sheets

PACKING CONTAINER AND BLANK FOR USE IN THE MANUFACTURE THEREOF

FIELD OF THE INVENTION

The present invention relates to a packing container and more particularly, a packing container of foldable material with bottom and side walls and an openable closure. The present invention also relates to a blank for the manufacture of a packing container of foldable packing material which by means of crease lines is divided into a number of wall panels for the formation of the bottom, side walls and an openable top closure.

BACKGROUND OF THE INVENTION

Packing containers fabricated from flexible packing material, e.g., paper and plastics laminate, exist in a great number of forms and are used, among other things, for the packaging of liquid foodstuffs, e.g., milk and juice. A packing container of this type is the so-called gable-top package which comprises four side walls, a plane bottom and a rooflike top part which has main panels inclined towards one another, whose upper parts are sealed together to a sealing fin.

In the type of packing container described above, it is possible in general to open portions of the top part and form them to a pouring spout. The opening arrangement itself may be designed in a number of different ways, but usually the actual top seal between the upper ends of the different wall panels or the folds included in the top is utilized as an opening arrangement. When the packing container is to be opened, the top seal produced in the manufacture of the packing container is then broken so that some of the panels folded inwardly can be folded out in order to form a pouring spout. The openability of the packing container consequently will depend to a great extent on the strength of the top seal which means in practice that a choice has to be made between a good, and thus tight, top seal and an easily openable but less tight top seal. To eliminate this problem it has been proposed to separate the sealing and opening function by providing the packing material at a suitable place with another type of opening arrangement, e.g., a perforation line. This, however, means a more complicated manufacturing process and, since the perforation line has to be placed below the top seal of the packing container, the opening arrangement gets close to the liquid surface in the packing container which is a disadvantage upon opening of the packing container as well as during pouring out of the liquid contents from the packing container.

The original design with a combined top seal and opening arrangement is generally preferred, and it has been attempted, therefore, in recent times to optimize this design to obtain a good seal and tightness as well as good openability. Since the top of the packing container usually is heat-sealed by fusing together layers of thermoplastic material situated on the outside of the packing material, several of these attempts were based on a reduction of the sealing strength within the limited region of the top seal, which is used in the opening of the packing container while at the same time maintaining the sealing temperature and the sealing pressure. This reduction of the sealing strength may be achieved, for example, by providing the packing material within the region which is to be readily openable with an uneven surface, so that the total adhesion area within this region is reduced (EP-A-185.325). However, this technique has proved to be subject to certain disadvantages and it has been found difficult in practice to obtain the predetermined, desired sealing strength. This disadvantage can be overcome with the help of another known technique (EP-A-270.869), according to which the region of the top seal which is to be opened is provided with a coating of a seal-preventing means which can be applied to the packing material in advance by means of a printing process. This technique provides a readily openable packing container which, however as a result of certain combinations of seal-preventing means and plastic coatings on the packing material may cause the packing containers to leak. This problem is accentuated especially in packing containers which are used for aseptic contents. For this type of contents and packing container the demands on tightness are extremely high, since even a so-called microleakage impairs the sterile conditions and reduces the keeping properties of the product to an appreciable degree.

Another known technique (U.S. Pat No. 4,712,727) uses laminated pieces of strip which include layers of an adhesive and which are placed on the region of the blank where a limited closing force is desired, that is to say at the top on both sides of the folded-in pouring spout. However, the handling and placing of the individual pieces of strip in the correct position on the blank is difficult to master and the method, moreover is relatively expensive.

It is evident from the above that it has not been possible up to now to provide a packing container of the gable-top type which has a top seal that is easily openable when an opening of the packing container is intended and which is completely tight. This demand has been particularly difficult to meet in aseptic packing containers, since even very small channels through the top seal may cause the sterility to be adversely affected, so that the keeping properties of the product no longer can be guaranteed.

OBJECTS AND SUMMARY OF THE PRESENT INVENTION

It is an object of the present invention, therefore, to provide a packing container of foldable material with a top closure which is easy to open and, in spite of this, is sufficiently tight for the packing container to be used advantageously for the packaging of aseptic products.

It is a further object of the present invention to provide a packing container with an opening arrangement which is not subject to the disadvantages which affected similar designs known previously.

It is a further object of the present invention to provide a packing container with a top closure whose tightness and opening properties remain good even at varying sealing temperatures and sealing pressures.

These and other objects have been achieved in accordance with the present invention in that a packing container of foldable material with bottom and side walls and an openable closure which comprises two main panels sealed to one another, and a bellows-fold situated therebetween with back-folding panels, whose surface facing towards the main panel comprises a coating of a seal-preventing means, has been provided with a heat-sealable film that extends over the coating of seal-preventing means.

A further object of the present invention is to provide a blank for the manufacture of packing containers with an openable top closure, the blank being designed and prepared so that the achievement of a top seal of the desired tightness and opening properties is assured.

A further object of the present invention is to provide a blank of this type which is not subject to the disadvantages which are typical for blanks known previously.

A further object of the present invention is to provide a packing container blank which is particularly well suited for the manufacture of packing containers in accordance with the present invention.

These and other objects have been achieved in accordance with the invention in that a blank for the manufacture of a packing container of a foldable packing material, which by means of crease lines is divided into a number of wall panels so as to form bottom and side walls and an openable top closure, these wall panels comprising two main panels and back-folding panels situated therebetween which have a coating of a seal-preventing means, has been provided with a film of heat-sealable material which extends over the coating of a seal-preventing means of the back-folding panels.

By providing the packing container and the blank in accordance with the invention with a heat-sealable film which covers the coating of seal-preventing means, well-defined and predictable sealing strength between the heat-sealable film and the seal-preventing means is obtained and a good mutual seal between the different sealing surfaces included in the top seal covered by the heat-sealable film is achieved. As a result, a good openability is achieved and a good seal in which the heat-sealable film effectively contributes towards preventing the occurrence of channels and microleakage is obtained. This makes it possible to use the packing container and the blank in accordance with the invention also for the packaging of aseptic contents in sterile packages.

BRIEF DESCRIPTION OF THE DRAWINGS

A preferred embodiment of the packing container as well as of the blank in accordance with the invention will now be described in more detail with special reference to the schematic drawings attached which only show the details necessary for an understanding of the invention, wherein.

DETAILED DESCRIPTION OF THE PREFERRED EMBODIMENT

Figure 1:
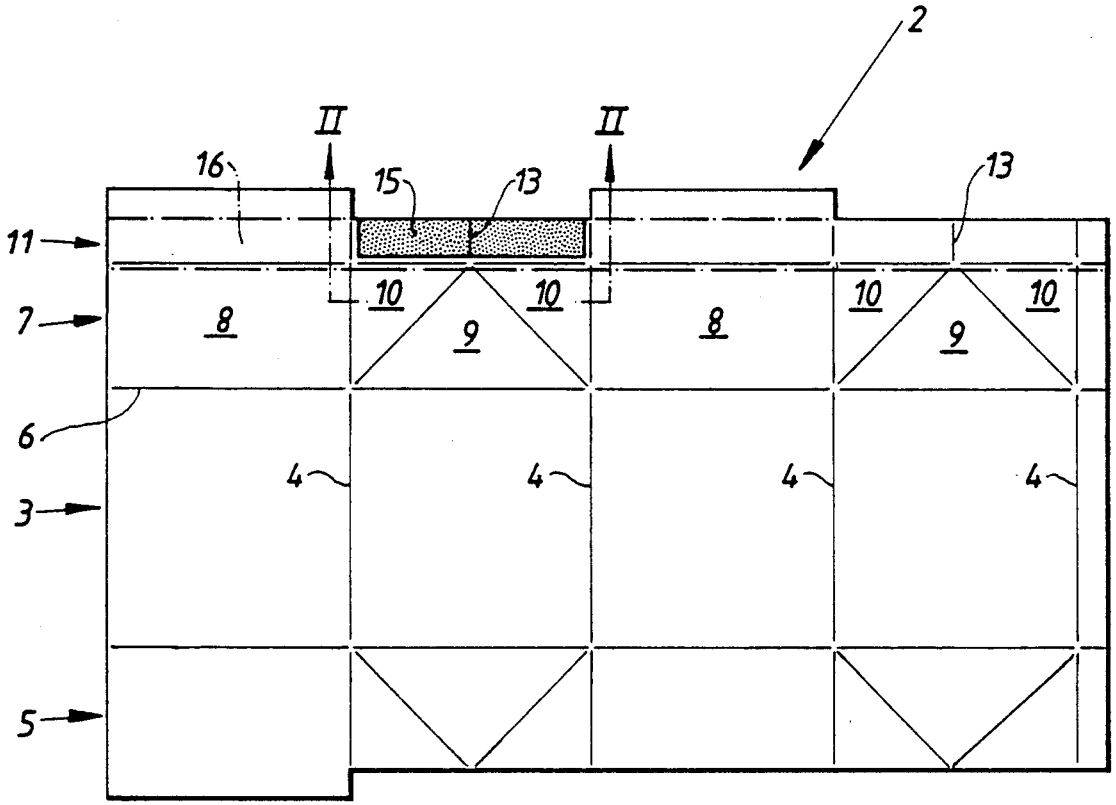
FIG. 1 is a plan view of a packing container blank in accordance with the present invention.

The preferred embodiment of the packing container as well as of the packing container blank in accordance with the invention which has been chosen as an illustration is a so-called gable-top package, but the invention is not limited to this type of packing container or packing container blank, but may be applied to any packing container which utilizes a sealed-in bellows-fold as an opening arrangement. The gable-top packing container 1 illustrated is of a conventional type and the packing container blank 2 illustrated (which is a laminate with external thermoplastic layers of a known type) thus comprises four side wall panels 3 which are divided by vertical crease lines 4. The four side wall panels 3 at their lower ends are provided with four bottom panels 5 which in known manner can be folded in and sealed so as to form a bottom in the packing container 1, which, however, is not part of the invention and is not, therefore, described in any more detail.

The four side wall panels 3 at their upper ends are separated by means of a horizontal crease line 6 from four top panels 7 which are mutually separated by means of the crease lines 4. The four top panels 7 comprise two main panels 8 and panels situated between these which by means of oblique crease lines are divided into a central, substantially triangular fold-in panel 9 and two likewise triangular back-folding panels 10 situated on either side of the panel 9. The top panel 7 at its upper free end has an elongated sealing zone 11 whose parts corresponding to the two main panels 8 are uninterrupted and substantially rectangular and whose parts situated in between are divided by means of vertical crease lines 13 into smaller parts belonging to the respective back-folding panels 10. The blank 2, moreover, is provided in a conventional manner with sealing panels and further crease lines and other details which, however, have been known previously to those versed in the art and which are, therefore, not necessary for an understanding of the invention.

The two back-folding panels 10, which jointly with the folding-in panels 9 situated between them are intended in the finished packing container to form a pouring spout 14 which can be folded out, are provided within the sealing zone 11 with a coating 15 of seal-preventing means, e.g. silicone. The seal-preventing coating 15 in accordance with the invention is covered by a heat-sealable film 16 which may be in the form of a strip extending along the whole length of the sealing zone 11 and which preferably substantially covers the sealing zone 11. The heat-sealable film 16 is sealed to the surface layer of thermoplastic material of the packing container blank 2 around the seal-preventing coating 15, so that on the finished packing container this coating is screened off from the inside of the packing container in a liquid-tight manner. The upper delimitation of the seal-preventing coating 15 preferably coincides with the top edge of the packing container blank 2 as well as with the top edge of the heat-sealable film 16.

On conversion of the packing container blank 2 in accordance with the invention to a packing container of the gable-top type (FIG. 3) the packing container blank is folded in a known manner along the four crease lines 4 and sealed together so that a substantially tubular body or square cross-section is produced. Subsequently the bottom panels 5 are folded in and are heat-sealed in order to form a liquid-tight bottom seal, whereupon the packing container is filled with contents to an appropriate level and the top is closed. The closing of the top takes place in that the two main panels 8 are let down towards one another with the relevant part of the crease line as a hinge at the same time as the fold-in panels 9 and back-folding panels 10 are folded in between the main panels 8. The sealing zones 11 of the top panels thereafter are sealed together through heating and compression and subsequent cooling, so that a liquid-tight top seal is obtained.

Figure 3:
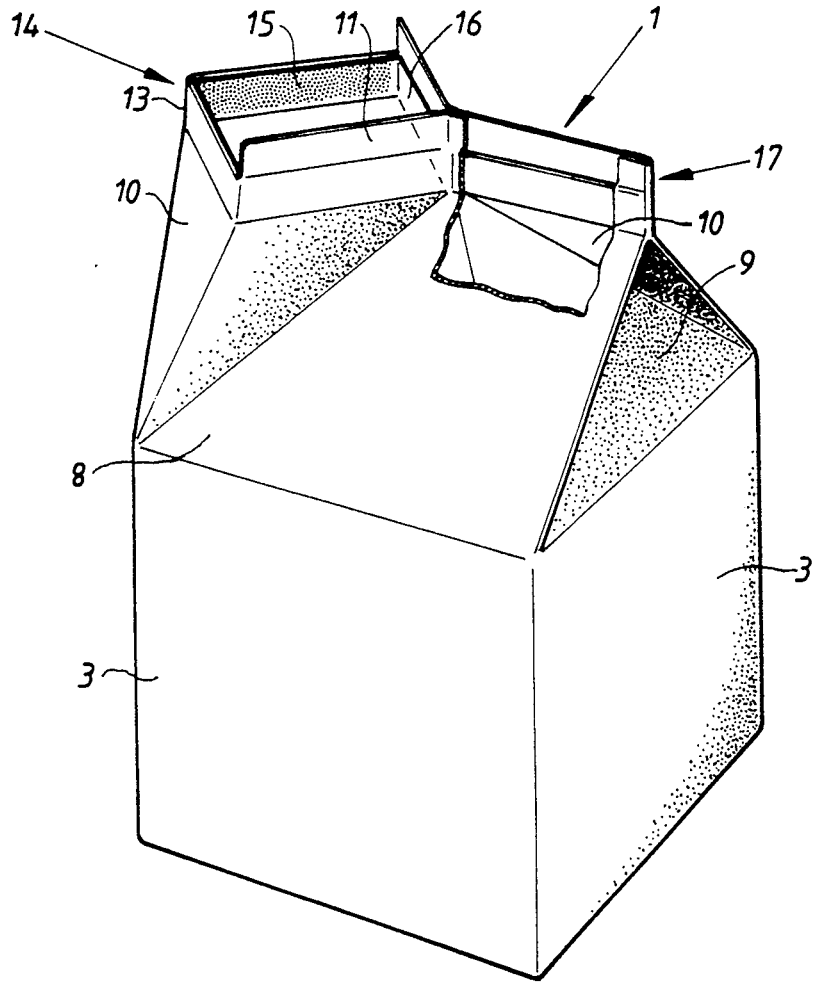
FIG. 3 is a perspective view, partially in section, of a packing container in accordance with the present invention in an opened condition.
Figure 4:
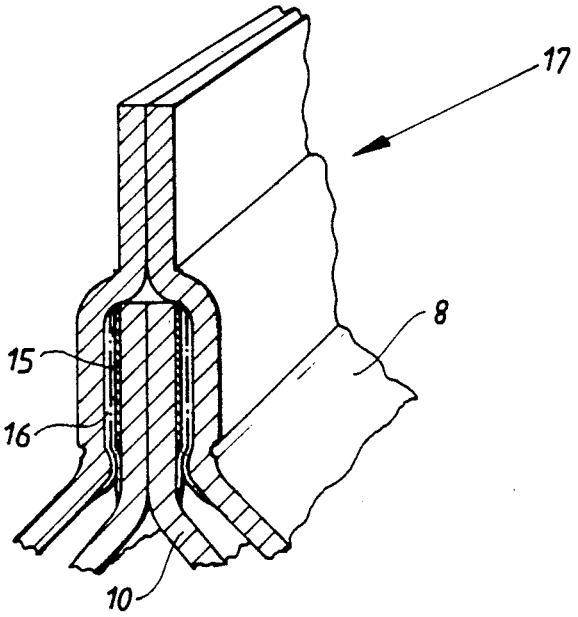
FIG. 4 is a cross-sectional view of a part of the packing container in accordance with FIG. 3.

The appearance of the top seal is illustrated in FIG. 4 which is a section through the upper part of the packing container in accordance with FIG. 3 and shows how the upper sealing zones 11 of the two main panels 8 are sealed together to an upright sealing fin 17 which encloses the upper parts of the back-folding panels 10 included in the sealing zone 11 which are to form the pouring spout 14 and thus are coated with the seal-preventing means 15. It is evident from FIG. 4 how the heat-sealable film 16 is situated between the different material layers included in the sealing fin 17 and contributes to increased tightness of the seal. As can be seen in particular from FIG. 4, the sealing zones of the two main panels are sealed directly to one another at the top part of the sealing fin 17 which ensures that they are sealed together in a very strong and tight manner. At the lower part of the sealing fin 17 the folded-in pouring spout with the seal-preventing coating 15 and the heat-sealable film 16 is sealed in between the two main panels 8, which implies that the sealing strength within this region is reduced and is determined exclusively by the adhesion between the seal-preventing coating 15 and the heat-sealable film 16. By virtue of this, the sealing strength within this region can be defined accurately during the manufacture of the packing container blank so that the sealing strength is not affected appreciably by other factors, e.g., the temperature and pressure on the sealing together of the fin after the filling of the finished packing container. The presence of the heat-sealable film 16 in the sealing zone also means that further thermoplastic material is provided which results in increased tightness, since the material can fill out better the channels and the recesses which may occur during the sealing. This enhanced tightness is particularly essential in order to prevent bacteria from penetrating into aseptic packages, but may also represent an advantage in respect of cost, since it may be possible to reduce the thickness of the liquid-tight thermoplastic layer of the packing material as this now simply has a liquid-tightening function.

Figure 2:
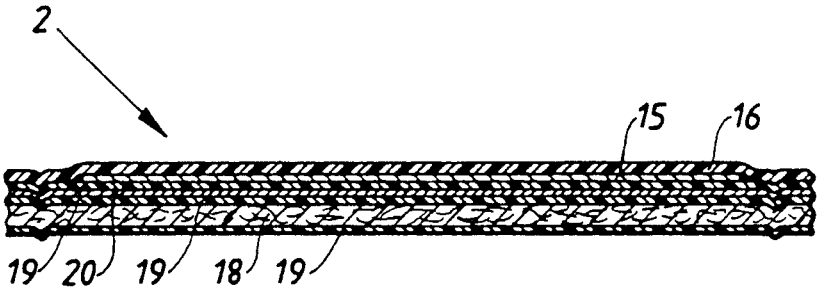
FIG. 2 is a cross-sectional view of a part of a packing container blank in accordance with FIG. 1.

As mentioned earlier, the packing container blank 2, preferably consists of a laminated material which comprises a central layer 18 of paper (FIG. 2) which is coated on either side with thin, liquid-tight layers 19 of thermoplastic material. On the side of the packing container blank which is intended to face inwardly towards the interior of the container and thus come into contact with the contents, the material is provided, moreover, with a barrier layer 20 of preferably aluminum foil, whose surface is covered by a further layer 19 of thermoplastic material. From the enlarged region in FIG. 2 it is evident moreover that the inner thermoplastic layer 19 is covered partially by the seal-preventing coating 15 which is in turn is covered by the heat-sealable film 16.

The heat-sealable film 16 preferably comprises a heat-sealable material, e.g., polythene, which on the side facing towards the seal-preventing coating has a layer of a material sealable to the inside of the packing laminate. With an inside coating of thermoplastic material, usually LDPE, that layer may consist appropriately of a polymer or copolymer based acrylic acid, and a typical film of this type thus is a co-extruded film which has a layer of a polymer or copolymer based acrylic acid intended for heat-sealing to the polythene layer of the packing laminate and a polythene layer. The total thickness is approximately 25 μm, whereof the thickness of the LDPE layer constitutes approximately 75%. When the packing container is intended for the aseptic packaging of sterile contents or when especially high demands are made on gas-tightness, the heat-sealable film moreover may comprise a layer of a barrier plastics, e.g., nylon or polyester. The heat-sealable film in this instance naturally also comprises the further layers which may be necessary for bonding together the layers included in the film, that is to say any suitable adhesive material. A typical film for this purpose in accordance with the invention (as seen from the side sealable to the packing laminate and facing towards the seal-preventing coating) comprises a layer of a polymer or copolymer based on acrylic acid, a layer of bonding agent, a layer of barrier plastics (nylon, polyester, etc.), a further layer of bonding agent and a heat-sealable material layer, e.g., polythene.

When during the manufacture of the packing container blank 2 of the heat-sealable film 16 is applied along the sealing zone 11, the film is heat-sealed to the inside layer of the packing laminate along the whole length of the film. The heat-sealable film 16 then will be strongly bonded to the inside layer while the seal to the seal-preventing coating 15 will be weaker and will be determined exclusively by the chosen combination of the seal-preventing coating and the material type of the film 16 facing towards the coating 15. When the packing container blank after the conversion to packing containers is to be top sealed, the sealing strength between the seal-preventing coating 15 and the heat-sealable film 16 will not be altered or influenced by the sealing temperature and the sealing pressure, which ensures that the adhesion force defined through the choice of material is defined. During the sealing of the top part of the package, the part of the heat-sealable film 16 situated above the seal-preventing coating will be sealed strongly to adjoining parts of the sealable film 16, i.e., the parts of the sealing film 16 which cover the adjoining halves of the two main panels. When the packing container is to be opened the relatively strong seal between the two main panels 8 formed on the upper part of the sealing fin 17 is broken first whereafter the seal between the coating 15 and the film 16 is broken, so that the two back-folding panels 10 forming the pouring spout 14 can be folded out. The part of the heat-sealable film 16 applied over the seal-preventing coating 14 will remain on the adjoining parts of the two main panels 8, so that the seal-preventing coating 14 is exposed along the pouring edge of the pouring spout. As a result, the pouring out of the contents present in the packing container can take place over a clean and even surface, which has no torn-off parts or residual shreds from the seal. In the region below the seal-preventing coating 15, however, residual shreds or remains of the heat-sealable film 16 may be left, but these shreds are at a relatively great distance from the pouring edge of the pouring spout 14 and in practice do not affect the pouring.

Since the packing material, as mentioned earlier usually consists of a laminate which, among other things, has an outer layer of thermoplastic material (i.e., a layer which subsequently adjoins the contents), this thermoplastic layer may be used, of course, in accordance with an alternative embodiment of the invention, as the heat-sealable film 16 instead of a separately applied striplike film. In this instance, obviously, the seal-preventing coating 15 has to be applied directly below the external thermoplastic layer of the laminate, i.e., between this and the underlying layer which, depending on the type of packing material, may be a further (internal) thermoplastic layer, a barrier layer or, if the barrier layer is lacking, the central carrier layer 18 of paper. The application of the seal-preventing medium on this occasion is made within the intended region before the heat-sealable film is applied over the whole surface of the packing material. When the packing container is to be opened, then, as in the embodiment of the invention described earlier, the seal between the coating and the heat-sealable film (the thermoplastic layer) will be broken so that the pouring spout can be folded out. The thermoplastic layer will rupture along the lower edge of the coating, but any adhering remains or shreds which may be produced in the process do not interfere with the pouring out of the contents.

Through the application of a heat-sealable film over the seal-preventing coating of the pouring spout primarily two advantages ar obtained. In the first place the sealing strength in the opening region can be determined in advance and be defined in such a manner during the manufacture of the packing container blank that it is not affected by operations carried out subsequently, e.g., the top sealing of the packing container. The sealing strength will be independent of the quality and the type of the coating layer which the packing container blank has on the side facing towards the inside of the packing container, and will not be affected either by other factors such as changing material quality, contaminations or mechanical ruptures. The top seal, moreover, is influenced positively, since the heat-sealable film serves as an auxiliary material which provides a stronger and more homogeneous seal so that microleakage can be prevented, which is a substantial advantage when the arrangement in accordance with the invention is to be used on packing containers of the aseptic type. The seal-preventing coating 15 as well as the heat-sealable film 16 are simple to apply in connection with the manufacture of the material. The seal-preventing coating can be applied in an exact pattern at the desired location by means of a relatively simple printing process, while the heat-sealable film can be applied in the form of a continuous, prefabricated strip which is heat-sealed to the inside layer of the packing material.

While this invention has been illustrated and described in accordance with a preferred embodiment, it is recognized that variations and changes may be made and equivalents employed herein without departing from the invention as set forth in the claims.

What is claimed is:

1. A container, comprising:

a bottom wall, side walls connected to the bottom wall and a top having an openable closure through which contents in the container can be discharged, said openable closure including two oppositely positioned main panels and inwardly directed back-folding panels positioned between the two main panels, each of the main panels being connected to one of said side walls, each of the back-folding panels being connected to one of said main panels and having an inner surface that faces one of said main panels when said openable closure is closed, said packing container having a coating of seal-preventing means located on the inner surface of said back-folding panels and a heat-sealable film extending over the coating of seal-preventing means, the coating of seal-preventing means substantially preventing the formation of a seal between the seal-preventing means and the heat-sealable film.

2. The packing container according to claim 1, wherein said bottom wall, said side walls and said openable closure are fabricated from packing material and said heat-sealable film covers said seal-preventing means and is joined to said packing material to seal the seal-preventing means in a liquid-tight manner from the interior of the container.

3. The packing container according to claim 1, wherein said seal-preventing means is a strip of thermoplastic material that extends along an upper edge of the container and that is sealed between the main panels and the back-folding panels when the openable closure is closed.

4. The packing container according to claim 1, wherein said bottom wall, said side walls and said openable closure are fabricated from packing material and said heat-sealable film covers substantially the entire inner surface of said packing material.

5. A sheet material blank for constructing a sealed gabletop container, said blank comprising: first, second, third and fourth side wall panels; bottom closure panels for forming a bottom of said container; and first, second, third and fourth top panels connected respectively to the first, second, third and fourth side wall panels, said top panels each including a sealing zone spaced from said side wall panels, said second and fourth top panels including a substantially triangular fold-in panel and a pair of substantially triangular back folding panels, with the apex of each fold-in panel being located approximately midway of the length of the sealing zone of the respective top panel, said sealing zones each having a heat sealable layer of thermoplastic material extending thereacross, said sealing zone at said second panel having a seal preventing coating located thereon, and a heat sealable film superimposed on said seal preventing coating and overlapping the edges of said seal preventing coating, whereby when said container is formed from said blank with the sealing zones heat sealed, said seal preventing coating is easily separated from said thermoplastic layer upon opening.

6. The blank according to claim 5, wherein said heat-sealable film is a strip of material that extends over at least a portion of said sealing zones as well as said seal preventing coating.

7. The blank according to claim 5, wherein said seal preventing coating is a silicone.

8. The blank according to claim 5, wherein said heat sealable film is formed of a polymer based acrylic acid.

9. The blank according to claim 5, wherein said heat sealable film is formed of a copolymer acrylic acid.

10. The blank according to claim 5, wherein said side wall panels, said top panels and said bottom panels are laminated and include a layer of barrier material.

11. The blank according to claim 5, wherein said top panels, bottom panels and side wall panels are laminated and include a central layer which is coated on opposite sides with layers of thermoplastic material.

* * * * *